US007722032B2

(12) United States Patent
Sasaki et al.

(10) Patent No.: US 7,722,032 B2
(45) Date of Patent: May 25, 2010

(54) SHEET FEEDING DEVICE AND IMAGE FORMING APPARATUS

(75) Inventors: Hirobumi Sasaki, Tokyo (JP); Tomoo Suzuki, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 696 days.

(21) Appl. No.: 11/424,902

(22) Filed: Jun. 19, 2006

(65) Prior Publication Data

US 2007/0052163 A1 Mar. 8, 2007

(30) Foreign Application Priority Data

Sep. 7, 2005 (JP) ..... 2005-259050
May 19, 2006 (JP) ..... 2006-139965

(51) Int. Cl.
*B65H 1/26* (2006.01)

(52) U.S. Cl. ..... 271/157; 271/164

(58) Field of Classification Search ..... 271/157, 271/164, 162; 399/388, 391, 393, 405
See application file for complete search history.

(56) References Cited

U.S. PATENT DOCUMENTS 5,172,903 A * 12/1992 Haneda et al. ..... 271/171
7,029,006 B2 * 4/2006 Izumi et al. ..... 271/145
2004/0041333 A1 * 3/2004 Izumi et al. ..... 271/145
2005/0286947 A1 * 12/2005 Kitamura ..... 399/393

FOREIGN PATENT DOCUMENTS

JP 05-132240 5/1993

* cited by examiner

*Primary Examiner*—Patrick Mackey
*Assistant Examiner*—Michael C McCullough
(74) *Attorney, Agent, or Firm*—Lucas & Mercanti, LLP

(57) ABSTRACT

A sheet feeding device, includes a sheet loading table; a sheet feeding member that feeds a sheet from an uppermost portion of sheets stacked on the sheet loading table; a regulating member that regulates a side of sheets, in a transverse direction orthogonal to a sheet feeding direction; an opening and closing mechanism that opens and closes a sheet feeding section; a lowering mechanism that lowers the sheet loading table that holds sheets at a sheet feeding position, to a lower position by opening the opening and closing mechanism; an adjusting mechanism that adjusts a position of the regulating member in the transverse direction; and a holding mechanism that holds a position of the sheet loading table so as to hold the sheets at the sheet feeding position even when the opening and closing mechanism is opened.

6 Claims, 7 Drawing Sheets

FIG. 6 ( a )
FIG. 6 ( b )
FIG. 6 ( c )
FIG. 6 ( d )
101
100B
1ST STORAGE SECTION
2ND STORAGE SECTION
HANDLE
S
A
C
20a
101A
104
105
106
107a
107b
130
135
142a
142b
143
145A
146
156
165

SHEET FEEDING DEVICE AND IMAGE FORMING APPARATUS

FIELD OF THE INVENTION

The present invention relates to a sheet feeding device and an image forming apparatus provided with the sheet feeding device, wherein image forming at a predetermined position of a sheet is achieved in a light printing process or the like, overcoming the problem of angle deviation of the sheet.

BACKGROUND OF THE INVENTION

For example, it is known to use an electrophotographic image forming apparatus, such as a copier, printer or facsimile machine, form images on the front and back sides of sheets, and bind a bundle of the sheets to produce a book. In the case of using an image forming apparatus in such a manner, highly accurate positioning of an image on a sheet is required. In other words, high quality image forming free from position deviation of images on the front and back sides of a sheet is required. Further, in the case of cutting the edge portions of plural sheets after binding, images may be partially cut off to be missing if the positions of edge portions of formed images are not correctly aligned.

In general, a sheet feeding device is provided with regulating members to regulate the sides of sheets stored in a sheet feeding tray, along the transverse direction. When regulating members are accurately collided with sheets for regulation, almost no shift or angle deviation of sheets is caused. However, as disclosed in Japanese Unexamined Patent Application Tokkaihei No. H05-132240, an image forming apparatus is, in general, provided with a plurality of sheet feeding devices, having a sheet loading table, for respective sizes of sheets, wherein when an opening and closing cover arranged on a sheet feeding device is opened, or when a sheet feeding tray is drawn out from the main body of a sheet feeding device, a sheet loading table with sheets stacked thereon is automatically falls to a lower position so that sheets can be supplied. Therefore, even when adjusting the position of regulating members, adjustment is carried out in a state where a sheet loading table has been lowered to a lower position. However, even trying to regulate sheets in the transverse direction in a state where a sheet loading table has been lowered to a lower position, the sheets are not at the sheet feeding position, but are below and too far from the sheet feeding position, which makes regulation in the transverse direction incorrect and cannot achieve a high accuracy.

That is, regulating members may be deformed depending on the accuracy of manufacturing, change with time, etc., and accordingly the distance between regulating members deviates between an upper position where sheets are actually fed and a lower position to which a sheet loading table has been lowered. Consequently, even adjusting regulating members correctly at a lower position to which a sheet loading table has been lowered, when sheets have risen to a position for actual sheet feeding thereafter, a gap may be created along the transverse direction between the side of the sheets and a regulating member to cause angel deviation of the sheets, prohibiting accurate regulation of the position of the sheets. Herein, angle deviation of sheets means a state where sheets are located not parallel to the sheet conveying direction, and have an angle deviation to the conveying direction.

Particularly, the angle deviation is significant in a large capacity tray (LCT) with a large rise and fall amount of a sheet loading table.

For solution of problems, as described above, and adjustment of regulating members that is sufficiently accurate, it is necessary that sheets are held at a sheet feeding position at the time of adjustment. Herein, the adjustment can be made by an input via an operation unit, by opening an opening and closing cover of a sheet feeding device, or by drawing out a sheet feeding tray. On the other hand, when supplying sheets, it is necessary that a sheet loading table falls and then sheets can be supplied. An object of the invention is to provide a sheet feeding device that can feed a sheet at a highly accurate position by adjusting the positions of regulating members with a simple mechanism and an image forming apparatus provided with such a sheet feeding device.

SUMMARY OF THE INVENTION

The invention includes the following structures.

(1) A sheet feeding device, including:

a sheet loading table;

a sheet feeding member that feeds a sheet from an uppermost portion of sheets stacked on the sheet loading table;

a regulating member that regulates a side of sheets, in a transverse direction orthogonal to a sheet feeding direction;

an opening and closing mechanism that opens and closes a sheet feeding section;

a lowering mechanism that lowers the sheet loading table that holds sheets at a sheet feeding position, to a lower position by opening the opening and closing mechanism;

an adjusting mechanism that adjusts a position of the regulating member in the transverse direction; and a holding mechanism that holds a position of the sheet loading table so as to hold the sheets at the sheet feeding position even when the opening and closing mechanism is opened.

(2) An image forming apparatus, including the sheet feeding device of above item (1) and an image forming unit that forms an image.

PREFERRED EMBODIMENTS OF THE INVENTION

Embodiment 1

Figure 1:
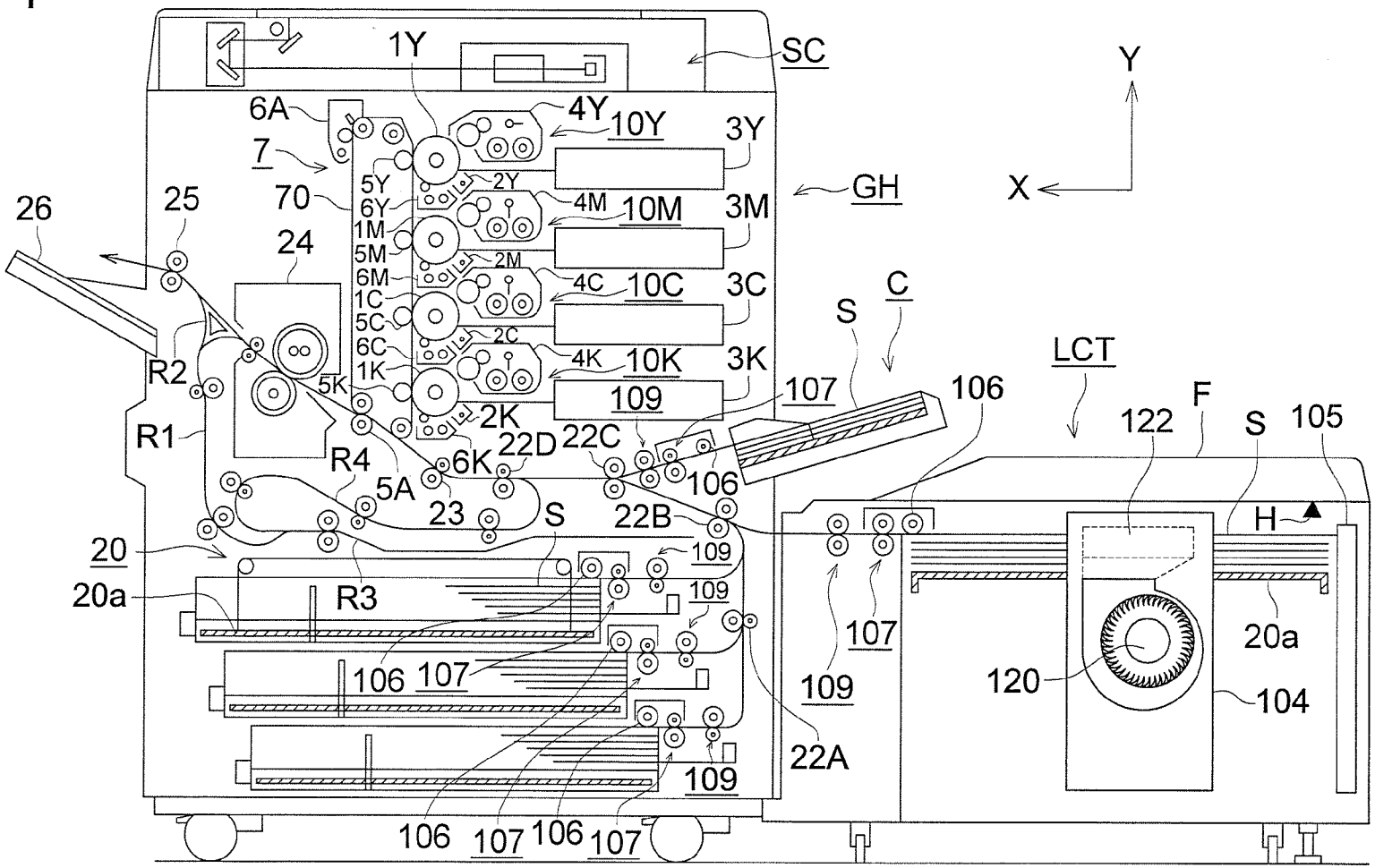
FIG. 1 is a cross-sectional structural view of an image forming apparatus provided with a sheet feeding device as an example of an embodiment in accordance with the invention.

An embodiment in accordance with the invention will be described below, referring to the drawings.

Herein, the description of the present embodiment does not limit the scope of the invention.

Regarding X, Y and Z directions shown in the respective figures, X direction represents the left direction when an image forming apparatus in the present embodiment is viewed from the front, and Reverse X direction represents the right direction. Y direction represents the up direction when the apparatus is viewed from the front, and Reverse Y direction represents the down direction. Z direction represents the depth direction when the apparatus is viewed from the front, and Reverse Z direction represents the front direction.

FIG. 1 is a cross-sectional structural view of an image forming apparatus provided with a sheet feeding device as an example of embodiment in accordance with the invention. This image forming apparatus is called a tandem type color image forming apparatus including a plurality of image forming units 10Y, 10M, 10C and 10K, an intermediate transfer unit 7, a fixing device 24 and the sheet feeding device. An image reading device SC is disposed at the top portion of an image forming device main body GH. As an example of a sheet feeding device in accordance with the invention, a large capacity tray (LCT) in the present embodiment is arranged on the right side, in FIG. 1, of the image forming device main body GH. Sheets are supplied from the large capacity tray LCT, sheet feeding trays 20 or a manual sheet feeding tray C.

The image forming unit 10Y for forming yellow colored images includes a charging unit 2Y, exposing unit 3Y, developing unit 4Y, primary transfer roller 5Y as a primary transfer unit, and cleaning unit 6Y which are disposed around a photoreceptor 1Y. The image forming unit 10M for forming magenta colored images includes a photoreceptor 1M, a charging unit 2M, exposing unit 3M, developing unit 4M, primary transfer roller 5M as a primary transfer unit, and cleaning unit 6M. The image forming unit 10C for forming cyan colored images includes a photoreceptor 1C, a charging unit 2C, exposing unit 3C, developing unit 4C, primary transfer roller 5C as a primary transfer unit, and cleaning unit 6C. The image forming unit 10K for forming black colored images includes a photoreceptor 1K, a charging unit 2K, exposing unit 3K, developing unit 4K, primary transfer roller 5K as primary transfer unit, and cleaning unit 6K.

An intermediate transfer unit 7 includes an intermediate transfer body 70 that circulates, driven by plural rollers, and serves as the second image carrier which is a semiconductive endless belt supported by the rollers to be able to circulate.

Images in respective colors formed by the image forming units 10Y, 10M, 10C and 10Y are sequentially transferred onto an circulating intermediate transfer body 70 by the primary transfer rollers 5Y, 5M, 5C and 5K to form a composite color image. Each sheet S loaded on one of the sheet feeding tray 20, manual sheet feeding tray C and the large capacity tray LCT is fed one by one by a sheet feeding roller 106 being a sheet feeding member and separating rollers 107, conveyed through pre-registration rollers 109, which are the first registration member, intermediate rollers 22A, 22B, 22C and 22D, which are conveying members, and then the front end of the sheet S is collided with registration rollers 23, which are the second registration member so that angle deviation of the sheet is corrected.

Thereafter, synchronizing with image forming by the image forming units 10Y, 10M, 10C and 10K, registration rollers 23 start rotating to convey the sheet S to the secondary transfer roller 5A being the secondary transfer section to transfer the color image onto the sheet S in a batch. The sheet S onto which the color image has been transferred is subjected to fixing processing with a fixing device 24 and then sandwiched by ejection rollers 25 to be loaded on an external ejection tray 26.

On the other hand, from the intermediate transfer body 70 after transferring the color image onto the sheet S, residual toner is removed by a cleaning unit 6A and collected into a box.

The primary transfer roller 5K is always in press contact with the photoreceptor 1K during image forming. The other primary transfer rollers 5Y, 5M and 5C are in press contact with the corresponding photoreceptors 1Y, 1M and 1C only when a color image is formed. The secondary transfer roller 5A comes in press contact with the intermediate transfer body 70 only when the sheet S comes and secondary transfer is performed.

Next, a sheet feeding device in accordance with the invention to be used for the image forming apparatus in FIG. 1 will be described in details, taking the example of the large capacity tray LCT.

As shown in FIG. 1, the large capacity tray LCT is provided with an opening and closing cover F as a mechanism to open and close the sheet feeding section. Further, an opening and closing detection sensor H is provided to detect opening and closing of the opening and closing cover F.

Figure 2:
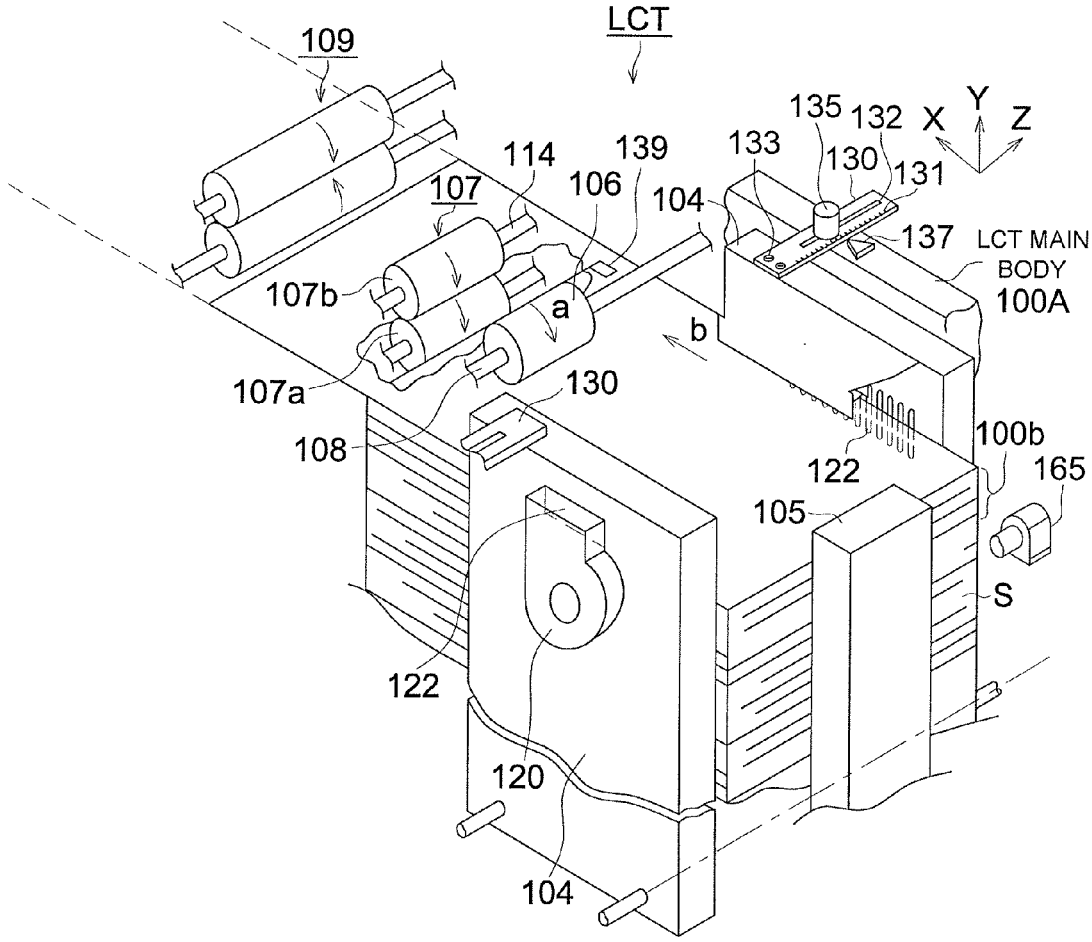
FIG. 2 is a perspective view of a sheet feeding section in a state where an opening and closing cover F is removed from a large capacity tray LCT.

FIG. 2 is a perspective view showing the sheet feeding section in a state where the opening and closing cover F is removed from the large capacity tray LCT. In FIG. 2, plural sheets S are loaded on a sheet loading table 20*a*, shown in FIG. 1, and supported to be able to rise and fall. Regulating members 104 for regulating the edges of sheets S move in the direction that is orthogonal to the sheet S feeding direction (shown as X direction) and is the transverse direction (shown as Z direction and Reverse Z direction) in the present embodiment. The regulating members 104 contact with the both sides of sheets S loaded on the sheet loading table 20*a* to regulate the both sides of the sheets S. A back edge regulating member 105 moves in the sheet S feeding direction (shown as X direction and Reverse X direction). The back edge regulating member 105 regulates the back edges of the sheets S in the sheet feeding direction. A sheet feeding roller 106 for feeding sheets is provided at the front end, in the sheet feeding direction, of sheets S and press-contacts the uppermost sheet S at a predetermined pressure.

When the sheet feeding roller 106 rotates in the direction arrow 'a', the uppermost sheet S is conveyed in the direction arrow 'b' and is conveyed to the separating rollers 107 provided on the downstream side of the sheet feeding roller 106. When double feeding occurs, the lower separating roller 107*a* which is rotated by a torque limiter in the same direction as arrow 'a' pushes back the sheets after the uppermost one so that only the uppermost one sheet is conveyed by an upper separating roller 107*b* rotating in the arrow direction. Herein, the pair of the lower separating roller 107*a* and upper separating roller 107*b* form the separating rollers 107.

The front end of a sheet S conveyed by the upper separating roller 107*b* is collided with the pre-registration rollers 109, which are the first registration member. The pre-registration rollers 109 are a pair of facing rollers and rotate in the arrow direction. After the sheet S is collided with the pre-registration rollers 109, the pre-registration rollers 109 starts conveying the sheet S at a predetermined timing, and the sheet S is conveyed through the registration rollers 23 being the second registration member to the secondary transfer roller 5A.

Herein, the registration members in accordance with the invention have functions to start and stop sheet conveying and to correct angle deviation of a sheet that is conveyed, under control by a conveyance control section 303 of a control unit A.

Each regulating member 104 is provided with a small fan 120 as a sheet separating member and an air feed opening 122. Air fed out upward from the fan 120 turns 90 degrees by a fan fitting plate and is blown out from the air feed opening 122 substantially horizontally. The air feeding opening 122 is open near the top of the regulating member 104 and has a grid form so that foreign objects do not enter to damage the fan 120.

When the fan 120 rotates, air is fed out from the air feeding opening 122 to several sheets which are at the top portion of loaded sheets S. The fed air flows in from one side of the several sheets at the top portion of the sheets S and flows out through the gaps between the sheets. Thus, the tight-contact between sheets is weakened, and accordingly the several sheets at the top portion of the sheets S are separated into respective sheets. The sheet feeding roller 106 feeds only the uppermost sheet of such separated sheets S.

Figure 3:
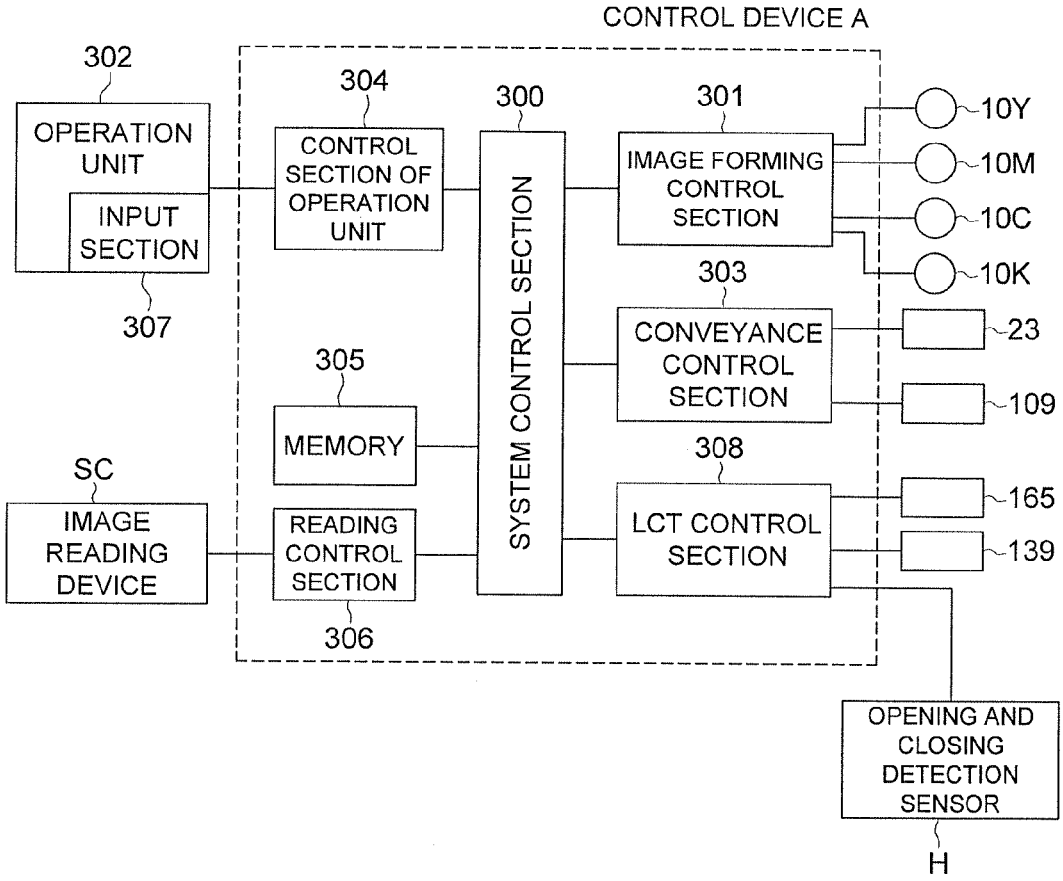
FIG. 3 is a block diagram of a control device A of an image forming apparatus provided with a sheet feeding device in accordance with the invention.

The control unit A of the image forming apparatus provided with the sheet feeding device in accordance with the invention will be described below, referring to the block diagram in FIG. 3.

The control unit A in accordance with the invention includes a CPU, a ROM that stores a control program, a memory 305 that stores image data, etc., and controls respective members shown in FIGS. 1 and 2. In order to describe objects of control in categories, the control unit A is described for convenience in categories of a system control section 300, image forming control section 301, conveyance control section 303, operation-unit control section 304, reading control section 306 and LCT control section 308 that controls driving and stopping position of the sheet loading table of the large capacity tray LCT.

The system control section 300 controls the respective control sections of the image forming apparatus as a whole and performs scheduling of image forming and the like.

The image forming control section 301 controls the image forming units 10Y, 10M, 10C and 10K, the intermediate transfer body 7, the fixing device 24, etc.

The conveyance control section 303 receives a signal transmitted from the system control section 300, and controls the sheet feeding roller 106, separating rollers 107, pre-registration rollers 109, intermediate rollers 22A, 22B, 22C and 22D, and registration rollers 23. Specifically, the conveyance control section 303 controls motors that drive the respective rollers and electromagnetic clutches that switch drives.

The control section 304 of the operation unit controls the operation unit 302 related to display and operational input with an operation panel.

The reading control section 306 controls the operation of the image reading device SC.

The LCT control section 308 controls a driving motor 165 that drives lifting and lowering of the sheet loading table 20*a*, namely, controls lifting of the sheet loading table 20*a* so that sheets move up to a sheet feeding position, and controls lowering of the sheet loading table 20*a* to a lower position to supply sheets. Specifically, when Power ON or closing of the opening and closing cover F has been detected, the LCT control section 308 drives the driving motor 165 to start lifting of the sheet loading table 20*a*, and keeps lifting the sheet loading table 20*a* until the top surface of the loaded sheets is detected by the top surface detection sensor 139 provided at the upper portion, and then stops the sheet loading table 20*a*. Thus, sheets are held at the sheet feeding position, and thereby it becomes possible to feed sheets.

When Power OFF or opening of the opening and closing cover is detected, the LCT control section 308 drives the driving motor 165 to lower the sheet loading table 20*a* to a lower position.

Figure 4:
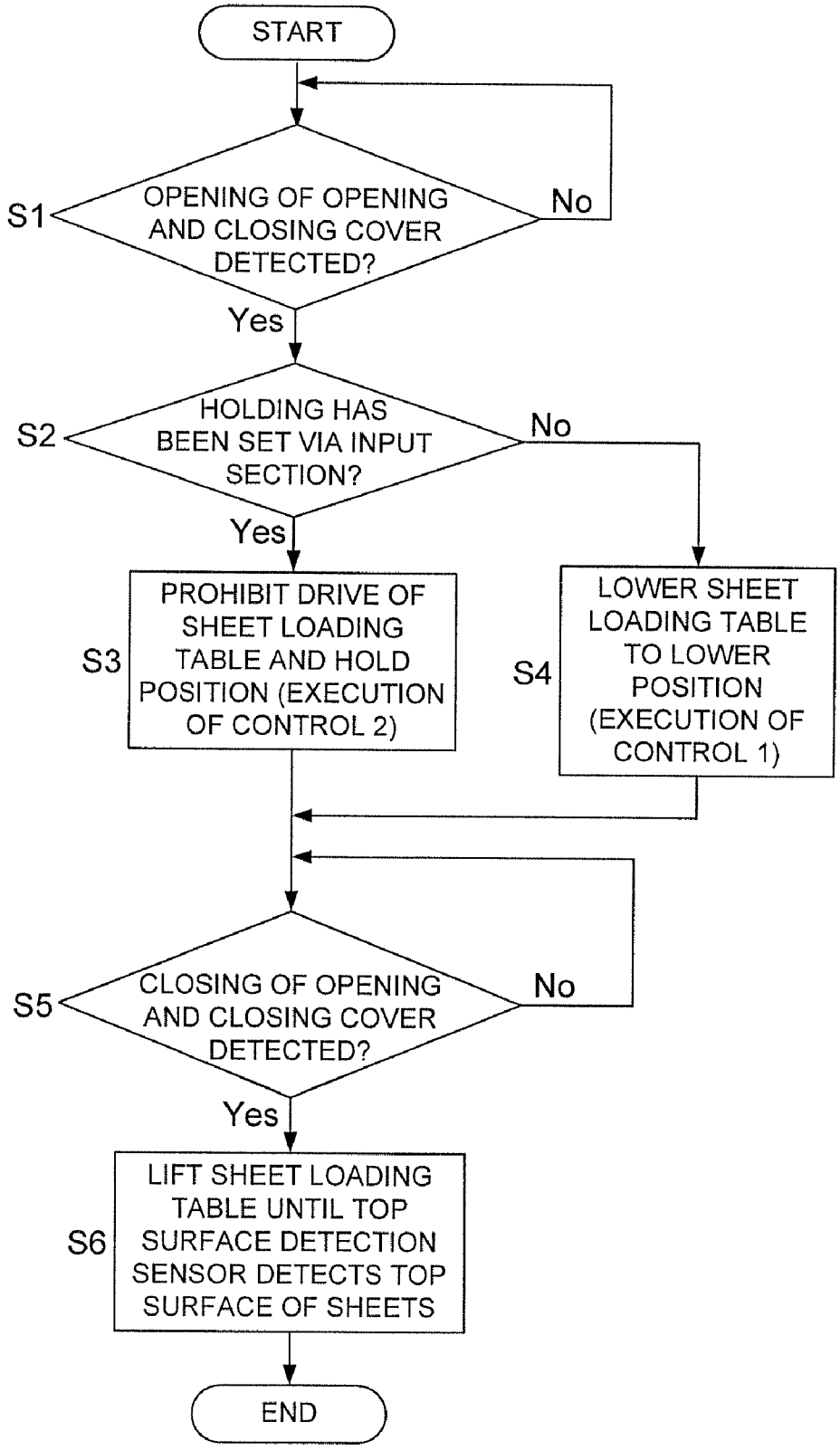
FIG. 4 is a flowchart of a control of lifting and lowering of a sheet loading table 20*a* in accordance with the invention.

Next, control of lifting and lowering of the sheet loading table 20*a* and adjustment of the regulating members 104 will be described, referring to FIG. 4.

A lowering mechanism in the present embodiment is implemented by an opening and closing detection sensor H to detect the opening operation of the opening and closing cover F which serves as an opening and closing mechanism; Control 1 to lower the sheet loading table that holds sheets at the sheet feeding position to the lower position in association with the opening operation when the opening and closing sensor has detected the opening operation; and the LCT control section 308, in the control device A, for the Control 1.

Further, a holding mechanism that holds the sheet loading table to hold sheets at the sheet feeding position in no association with the opening operation of the opening and closing mechanism is implemented by the opening and closing detection sensor H to detect the opening operation of the opening and closing cover F which serves as the opening and closing mechanism; Control 2 not to lower the sheet loading table that holds sheets at the sheet feeding position to the lower position in association with the opening operation when the opening and closing sensor has detected the opening operation, but to keep the drive of the sheet loading table in a stopping state so as to hold sheets at the sheet feeding position; and the LCT control section 308, in the control device A, for the Control 2.

In the invention, based on setting for holding or lowering the sheet feeding table 20*a* via the input section 307 of the operation unit 302, the LCT control section 308 controls to perform stopping by switching two positions, with Control 1 to hold the sheet loading table 20*a*, keeping it stopped at the position that allows feeding of sheets, and with Control 2 to lower the sheet feeding table 20*a* to the lower position for supplying sheets and stop there the sheet feeding table 20*a*.

Next, control of lifting and lowering of the sheet loading table 20*a* in accordance with the invention will be described in detail, referring to a flowchart in FIG. 4.

The opening and closing sensor H always monitors opening of the opening and closing cover F (step-S1). When the opening and closing detection sensor H detects opening of the opening and closing sensor F (Yes), the input section 307 determines whether input to hold the sheet feeding position has been set (step-S2). If input to hold the position has been set (Yes), Control 2 is executed to prohibit driving of the sheet loading table and hold the stopping state (step-S3). Thus, a user or service man can adjust the regulating members 104 of the large capacity tray LCT, while holding sheets at the sheet feeding position. If input to hold the sheet feeding position has not been set (No), Control 1 is executed to drive the sheet loading table downward to the lower position (step-S4). Thus, the sheet loading table is lowered to the lower position, allowing the user to supply sheets.

Then, the opening and closing detection sensor H monitors closing of the opening and closing cover F (step-S5). When the opening and closing detection sensor H detects closing of the opening and closing sensor F (Yes), then driving is controlled to lift the sheet loading table up to a point where sheets are at the sheet feeding position (step-S6). Herein, when Control 1 is executed, control to drive the sheet loading table is not executed particularly, since the sheets are held at the sheet feeding position.

Next, adjustment of the regulating members 104 to be performed after execution of step-S3, mentioned above, will be described.

The larger the capacity of the sheet feeding device, the regulating members 104 to guide the both sides of sheets have the longer vertical surfaces in the height direction, wherein the upper position and the lower position have different position dimensions in the transverse direction, which actually does not allow accurate dimensional positioning even if positioning is performed at a lower part. Further, in prior arts, in a sheet feeding device connected to an image forming apparatus, a sheet loading table is lowered to a lower position when the opening and closing cover F of a LCT is opened for a work of sheet supply or on a trouble, such as a jam. Accordingly, even if the image forming apparatus and the sheet feeding device is stopped for position adjustment of sheets in the transverse direction in a light printing process, and thus the positions of the regulating members 104 are adjusted for adjustment of the position of sheets to be fed, when the sheets reach the actual sheet feeding position, gaps may be created between the regulating members 104 and the sheets, which causes angle-deviation of sheets.

In the present invention, in order to avoid such a problem, when the opening and closing cover F of the LCT is opened by input setting via the input section 307 of the operation unit 302 at the time of adjusting the regulating members 104, the sheet loading table is controlled to hold a stopping state while it is held at the position for sheet feeding.

An adjusting mechanism, in accordance with the invention, for adjustment of the position of a regulating member 104 in the transverse direction includes a clamp 135 to fix the position, scale gauge 130 integrally fixed to the regulating member 104, index 137 fixed to the main body of the LCT, and the regulating member 104 movable in the transverse direction.

Adjustment of the position of the regulating member 104 by the adjusting mechanism unclamps the clamp 135 fixing the position, moves the regulating member 104 in the transverse direction (in Z direction or Reverse Z direction) for adjustment, with an indication by the measure 131 of the scale gauge 130 integrally fixed to the regulating member 104 and an indication by the index 137 fixed to the main body. Finally, the clamp 135 is tightened to fix the position. Since this adjusting operation can be performed in a state where sheets S are at the sheet feeding position, it is possible to make an accurate adjustment, while narrowing the gap between the regulating member 104 and the edges of the sheets S and visually checking so that the sheets S have no angle deviation. Further, micro adjustments, including readjustment at any time needed, can be made easily with the simple mechanism.

Further in the invention, when sheets are supplied to the LCT, the sheet loading table 20*a* is lowered to the lower position so that a large amount of sheets can be easily supplied.

An adjustment method for adjustment of regulating members 104 in the present Embodiment 1 will be described. In the adjustment method for adjustment of regulating members 104 in accordance with the present invention, a process is included, wherein when setting to hold the sheet loading table 20*a* by prohibiting a fall of it has been input via the input section 307 of the operation unit 302, the LCT control section 308 controls the driving of the sheet loading table 20*a* such that the sheet loading table 20*a* does not fall and sheets are held at the sheet feeding position. Thereafter, a process is executed that adjusts the position of the regulating members 104 in the state where the sheets are held at the sheet feeding position. On the other hand, another process is included, wherein when setting to lower the sheet loading table 20*a* that does not prohibit a fall of it is input via the operation unit 302, the LCT control section controls the sheet loading table 20*a* to fall to a lower position where sheets can be supplied. Then, a process to supply sheets onto the sheet loading table 20*a* is executed.

In the present embodiment, although prohibition of lowering the sheet loading table 20*a* is set by an input via the input section 307 of the operation unit 302 of the image forming apparatus, it is also possible, for example, to provide an input section on the sheet feeding device LCT.

Embodiment 2

A sheet feeding device shown in FIGS. 5, 6*a* to 6*d*, 7*a* and 7*b* in Embodiment 2 in accordance with the present invention will be described below as an example.

Figure 5:
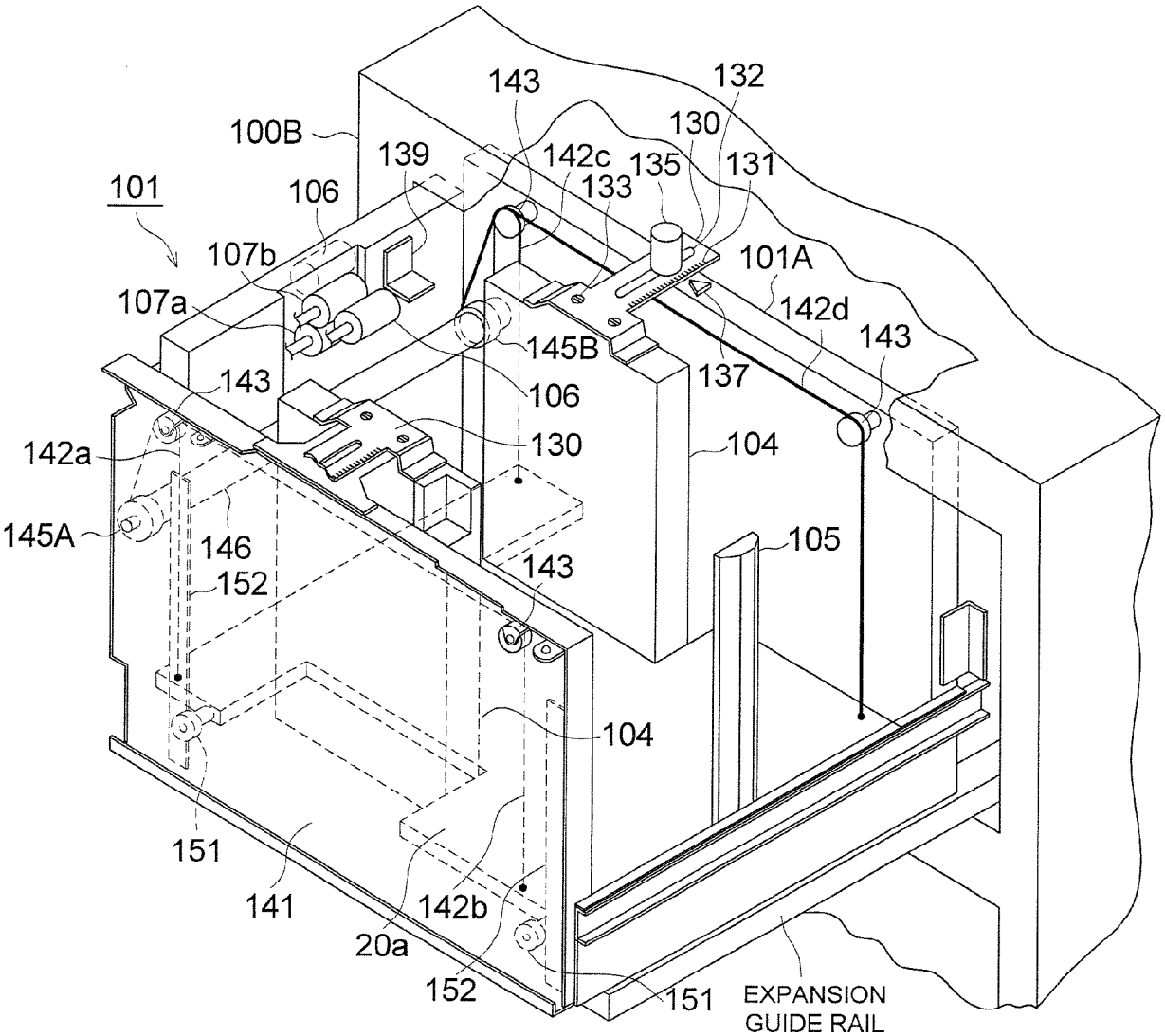
FIG. 5 is a perspective view showing a state where a sheet feeding tray 101 is drawn out from a main body frame 100B of the sheet feeding device.
Figure 6:
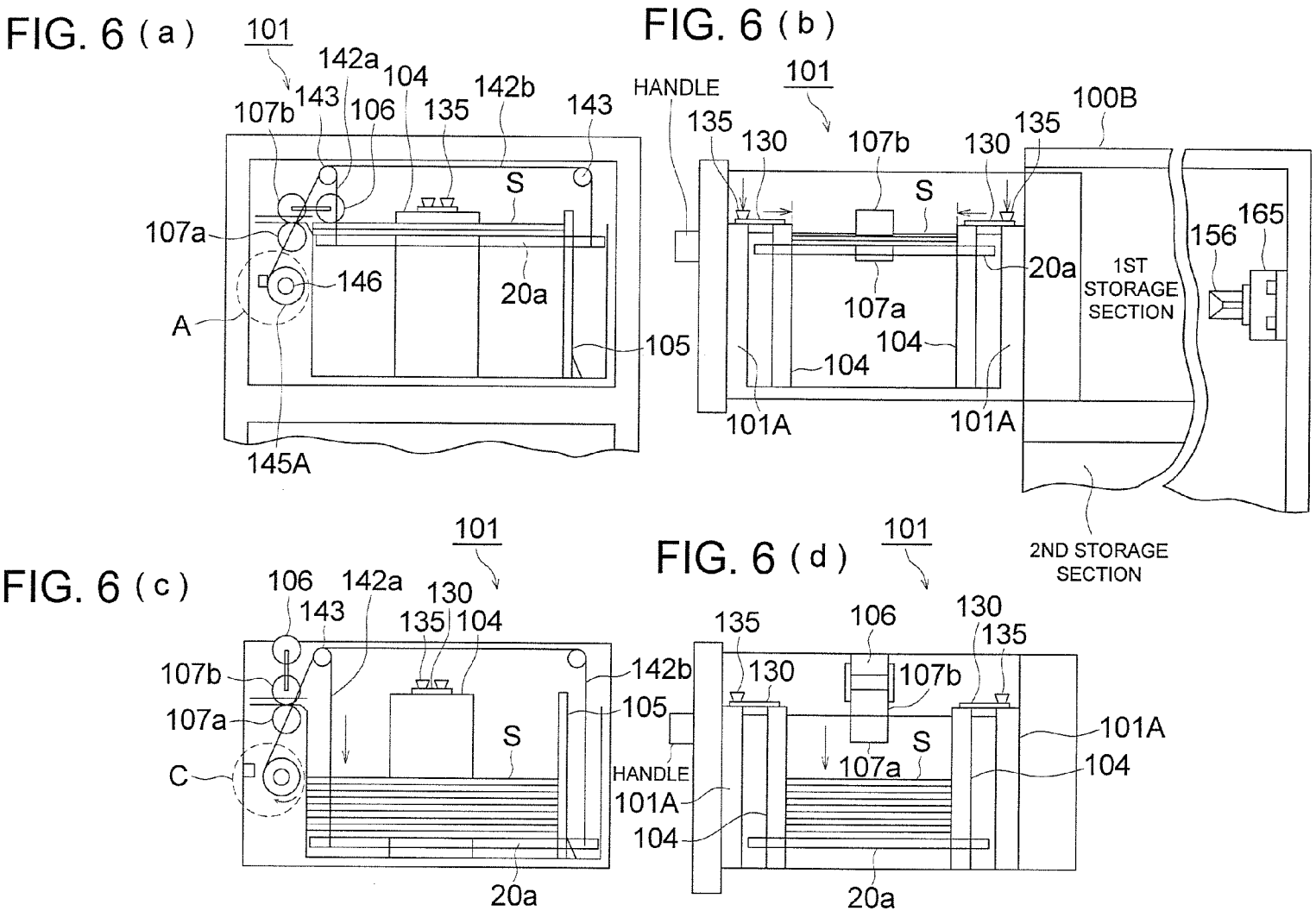
FIGS. 6*a* and 6*b* are a front view and side view of the sheet feeding tray 101 in a state where sheets are at a sheet feeding position.
FIGS. 6*c* and 6*d* are a front view and side view of the sheet feeding tray 101 in a state where sheets are supplied onto a sheet loading table.

In Embodiment 2, a sheet feeding section is opened by drawing out a sheet feeding tray 101 from a main body frame FIG. 5 is a perspective view showing a state where the sheet feeding tray 101 is drawn out from a main body frame 100B of the sheet feeding device. FIG. 6*a* and FIG. 6*b* are a front view and side view of the sheet feeding tray in a state where sheets are at a sheet feeding position, while FIG. 6*c* and 6*d* are a front view and side view showing a state where sheets are supplied onto a sheet loading table.

The structure of the sheet feeding tray will be described, referring to FIG. 5. The tips of wires 142*a*, 142*b*, 142*c* and 142*d* are fixed at the four corners of the sheet loading table 20*a* and guided by plural guide pulleys 143 provided and fixed to the sheet feeding tray 101. The other tips of the wires are fixed to winding pulleys 145A and 145B and the wires are wound and released. Further, guide rollers 151 arranged at the four corners of the sheet loading table 20*a* and guide rails 152 provided on the main body of the sheet feeding tray 101 enable stable rise and fall of the sheet loading table 20*a*.

The winding pulleys 145A and 145B are integrally connected with a drive transmission shaft 146. As shown in FIG. 6*b*, an engaging section provided at one end of the drive transmission shaft 146 is coupled with a coupling member 156 of a drive motor 165 provided on the main body frame 100B, and thereby the drive is transmitted. The drive transmission section includes the wires 142*a*, 142*b*, 142*c* and 142*d*, the winding pulley 145A and 145B, and the drive transmission shaft 146. The drive motor 165 is driven to lift the sheet loading table 20*a*. When the sheet feeding tray 101 is drawn out from the main body frame 100B, coupling between the engaging section and the coupling member 156 is released to cut off the transmission of the driving force, and accordingly the sheet loading table 20*a* falls to the lower position with the gravity thereof.

Figure 7:
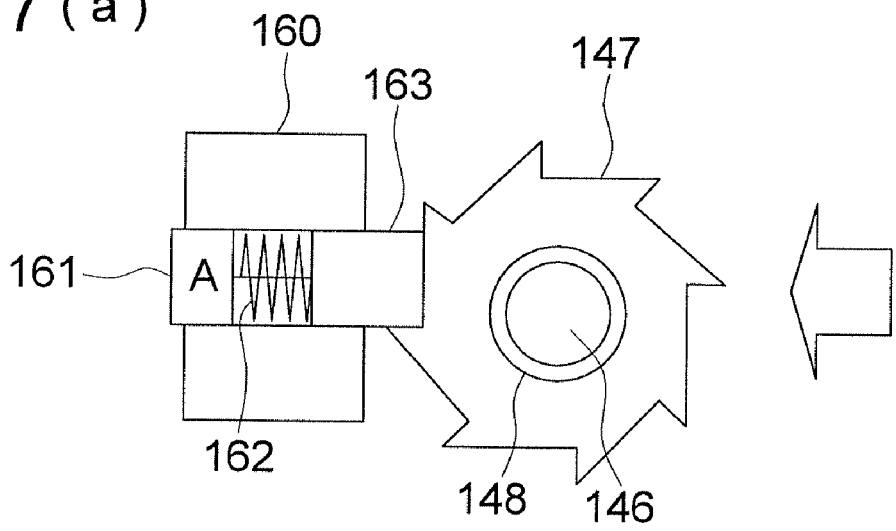
FIG. 7*a* is a detailed diagram of part A in FIG. 6*a*.
FIG. 7*b* is a detailed diagram of part C in FIG. 6*c*.
Figure 7:
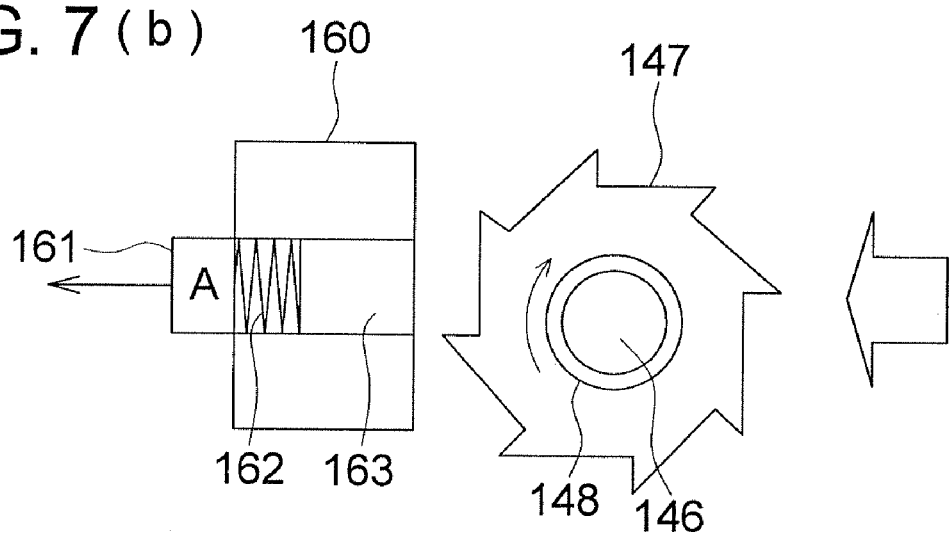

On the other hand, as shown in FIG. 7*a* being a detailed figure of A in FIG. 6*a* and FIG. 7*b* being a detailed drawing of C in FIG. 6*c*, the drive transmission shaft 146 for the winding pulleys 145A and 145B is fitted with a ratchet gear 147. A crank box 160 is provided on the side wall of the front part of the sheet feeding tray 101. The crank box 160 is provided with a clamp claw 163 as an inhibiting member through a lock button 161 and a spring 162, facing the ratchet gear 147. The clamp claw 163 is engaged with the ratchet gear 147 to inhibit driving. FIG. 7*a* shows the state where the clamp claw 163 is at the inhibiting position, and FIG. 7*b* shows the state where the clamp claw 163 is at the releasing position. By operation of the lock button 161 through the spring 162, the clamp claw 163 is engaged with the ratchet gear 147 to inhibit driving, or the engagement is released to permit the ratchet gear 147 to be driven. When the ratchet gear 147 is in the state of being stopped by the engagement with the clamp claw 163, the sheet feeding tray 101 is drawn out and the drive transmission section is released, and even if the connection with the drive motor 165 is cut off, the drive transmission shaft 146 is inhibited from driving, and thus the sheet loading table 20*a* does not fall and the sheets can be held at the sheet feeding position. The regulating members 104 can be adjusted in this state.

An adjusting mechanism to adjust the transverse position of a regulating member 104 in accordance with the invention includes a clamp 135, scale gauge 130 integrally fixed to the regulating member 104, index 137 fixed to the main body, and the regulating member 104 movable in the transverse direction.

In adjustment of the position of the regulating member 104 by the adjusting mechanism, the transverse position of the regulating member 104 is moved and adjusted with an indication by the measure 131 of the scale gauge 130 integrally fixed to the upper portion of the regulating member 104 and an indication by the index 137 fixed on a fixing frame 101A of the sheet feeding tray 101, and the regulating member 104 is fixed at a position decided by the clamp 135. Since the operation of this adjustment can be performed in a state where sheets S are at the feeding position, it is possible to make an accurate adjustment, while narrowing the gap between the regulating member 104 and the ends of the sheets S and visually checking so that the sheets S have no angle deviation. Further, micro adjustments, including readjustment at any time needed, can be made easily with the simple mechanism.

When the sheet feeding tray 101 is inserted into the sheet feeding device main body 100B in this state after adjustment, insertion of the sheet feeding tray 101 is detected and the drive motor 165 is driven, based on a detection signal, to start rising of the sheet loading table 20*a*. The sheet loading table 20*a* rises until the top surface of the loaded sheets is detected by a top surface detection sensor 139 provided at the upper part, and the sheet loading table 20*a* stops. In such a manner, the sheets are held at the sheet feeding position and sheet feeding becomes possible.

In order to draw out the sheet feeding tray 101 and supply sheets, the engagement of the ratchet gear 147 with the clamp claw 163 is released by releasing the lock button 161, the winding pulleys provided at the drive transmission shaft 146 becomes freely rotatable, and the sheet loading table 20*a* falls to the lower position with the gravity thereof.

Further, the ratchet gear 147 is provided with a one way clutch 148 which allows the drive transmission shaft 146 to rotate in the direction to lift the sheet loading table 20*a* even when the clamp claw 163 inhibits drive rotation of the ratchet gear 147. In such a manner, even when the clamp claw 163 inhibits drive rotation of the ratchet gear 147 during image forming, if the top surface of sheets S becomes lower than the sheet feeding position when some of the sheets S have been fed out, the sheet loading table 20*a* can be lifted such that the remaining sheets S rises to the sheet feeding position.

In the sheet feeding device including the sheet feeding tray 101 in the present Embodiment 2, the regulating members 104, scale gauges 130, sheet feeding roller 106, lower separation roller 107*a*, upper separation roller 107*b*, control device and the like have the similar structures and functions as those of the large capacity tray LCT in aforesaid Embodiment 1, and therefore detailed description is omitted here.

Further, by making it possible to shift the sheet feeding roller 106 away to an upper position, easy adjustment of regulating members and supply of sheets are achieved.

In accordance with the invention, it is possible to adjust the regulation of the side of sheets, in the transverse direction, not at a lower position below a sheet feeding position, but holding the sheets at the sheet feeding position. In such a manner, the traverse position of sheets can be accurately adjusted with a simple structure. Accordingly, creation of a shift or angle deviation between sheets and images can be prevented in image forming on the sheets, and stable image forming in a high quality without deviation can be attained. Further, when it is necessary to supply sheets, a sheet loading table is lowered to a lower position, allowing efficient supply of sheets.

What is claimed is:

1. A sheet feeding device, comprising:
- a sheet loading table;
- a sheet feeding member that feeds a sheet from an uppermost portion of sheets stacked on the sheet loading table;
- a regulating member that regulates a side of sheets, in a transverse direction orthogonal to a sheet feeding direction;
- a cover that opens and closes a sheet feeding section;
- a lowering mechanism that lowers the sheet loading table that holds sheets at a sheet feeding position, to a lower position;
- an adjusting mechanism that adjusts a position of the regulating member in the transverse direction;
- a holding mechanism that holds a position of the sheet loading table so as to hold the sheets at the sheet feeding position; and
- a control device that controls drive of the sheet loading table,
- wherein the control device performs control 1 or control 2 by a selection of a user,
- wherein the cover is an opening and closing cover or door that can be opened and closed;
- upon control 1 being selected by the user and the cover is opened, the control device performs control 1 that controls the lowering mechanism to lower the sheet loading table to the lower position; and
- upon control 2 being selected by the user and the cover is opened, the control device performs control 2 that controls the lowering mechanism not to lower the sheet loading table to the lower position, but controls the holding mechanism to hold the position of the sheet loading table so as to hold the sheets stacked on the sheet loading table at the sheet feeding position.

2. The sheet feeding device of claim 1, further comprising:
- an opening and closing detection sensor that detects opening and closing of the cover; and
- upon control 1 being selected by the user and the opening and closing detection sensor has detected opening of the cover, the control device performs control 1 that controls the lowering mechanism to lower the sheet loading table to the lower position; and
- upon control 2 being selected by the user and the opening and closing detection sensor has detected opening of the opening and closing mechanism, the control device performs control 2 that controls the lowering mechanism not to lower the sheet loading table to the lower position, but controls the holding mechanism to hold the position of the sheet loading table so as to hold the sheets stacked on the sheet loading table at the sheet feeding position.

3. The sheet feeding device of claim 2, comprising an input section through which the user sets lowering or holding of the sheet loading table by selecting control 1 or control 2.

4. The sheet feeding device of claim 1, comprising:

a sheet feeding tray;

a main body frame that houses the sheet feeding tray;

a drive motor that lifts the sheet loading table; and a drive transmission section that transmits driving force of the drive motor to the sheet loading table, wherein the cover causes the sheet feeding section to open when the sheet feeding tray is drawn out from the main body frame, and causes the sheet feeding section to close when the sheet feeding tray is housed into the main body frame; the lowering mechanism causes the sheet feeding table to fall when the drive transmission section is released to cut off transmission of driving force;

the holding mechanism includes an inhibiting member switchable between an inhibiting position to inhibit drive of the drive transmission section and a releasing position not to inhibit the drive, and is controlled by the control device such that the holding mechanism inhibits the drive of the sheet loading table to hold sheets at the sheet feeding position when the inhibiting member is at the inhibiting position, and lifts sheets on the sheet loading table up to the sheet feeding position and holds the sheets when the sheet feeding tray has been housed into the main body frame; and when the sheet feeding tray has been drawn out from the main body frame and the drive transmission section has been released, if the inhibiting member is at the inhibiting position, then the inhibiting member inhibits drive of the sheet loading table so as to hold the sheets at the sheet feeding position, and if the inhibiting member is at the releasing position, then the sheet loading table falls to the lower position.

5. The sheet feeding device of claim 4, wherein inhibition of drive of the drive transmission section by the inhibiting member is inhibition by engagement of a clamp claw, being the inhibiting member, with a ratchet gear provided at the drive transmission section.

6. An image forming apparatus, comprising the sheet feeding device of claim 1 and an image forming unit that forms an image.

* * * * *